US007170475B2

(12) United States Patent
Vissenberg

(10) Patent No.: US 7,170,475 B2
(45) Date of Patent: Jan. 30, 2007

(54) CATHDOLUMINESCENT DISPLAY DEVICE

(75) Inventor: Michel Cornelis Josephus Marie Vissenberg, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 150 days.

(21) Appl. No.: 10/506,840

(22) PCT Filed: Feb. 19, 2003

(86) PCT No.: PCT/IB03/00707

§ 371 (c)(1),
(2), (4) Date: Sep. 7, 2004

(87) PCT Pub. No.: WO03/077275

PCT Pub. Date: Sep. 18, 2003

(65) Prior Publication Data

US 2005/0122281 A1 Jun. 9, 2005

(30) Foreign Application Priority Data

Mar. 11, 2002 (EP) ..... 02075945

(51) Int. Cl.
*G09G 3/20* (2006.01)

(52) U.S. Cl. ..... 345/74.1

(58) Field of Classification Search ..... 345/55, 345/74.1, 75.1, 76; 315/169.3; 313/483, 313/495–497

See application file for complete search history.

(56) References Cited

U.S. PATENT DOCUMENTS

| | | | | |
|---|---|---|---|---|
| 2,899,597 | A | 8/1959 | Kompfner | |
| 4,215,293 | A | 7/1980 | Stanley | 315/366 |
| 5,781,166 | A | 7/1998 | De Zwart et al. | 345/76 |
| 5,990,609 | A * | 11/1999 | Knox et al. | 313/422 |

OTHER PUBLICATIONS

"Slalom Focusing"by J.S. Cook et al., Proceedings of the IRE, Nov. 1957, pp. 1517-1522.

* cited by examiner

*Primary Examiner*—Amr A. Awad
*Assistant Examiner*—Tom Sheng

(57) ABSTRACT

A display device is provided with a display screen (30) for displaying image information, having a predetermined number of luminescent picture elements (35). In operation, an electron beam (45) is generated by an electron gun (40) and entered into a two-dimensional slalom guide (10), wherein the beam is guided in two mutually perpendicular directions by means of slalom focusing. Subsequently, the electron beam (45) is extracted from a selected cell (56) of the slalom guide (10) towards a corresponding picture element (35). The path of the electron beam (45) in the slalom guide (10) can be fully customized within the guidance plane. Preferably, the guidance plane extends substantially parallel to the display screen (30).

20 Claims, 4 Drawing Sheets

CATHDOLUMINESCENT DISPLAY DEVICE

The invention relates to a display device, comprising:

a display screen for displaying image information, having a predetermined number of luminescent picture elements;

an electron gun for generating an electron beam and an electron beam guide for receiving the electron beam at a beam entrance and guiding said electron beam along a beam path to extraction means for extracting said electron beam from said beam guide, towards a predetermined picture element of the display screen.

An embodiment of such a display device is known from U.S. Pat. No. 4,215,293.

The luminescent picture elements (pixels) are generally arranged in rows and columns in a display device. The known display device has a vertical beam guide for each one of the columns of pixels, said electron beam guides consisting of slalom guides, the principle of which is described in the article entitled "Slalom Focusing" by J. S. Cook et al., *Proceedings of the IRE*, November 1957, pages 1517–1522.

The vertical beam guides partially overlap the display screen. In the overlapping part of the vertical beam guides, the electron beams slalom in a direction perpendicular to the display screen.

Each beam guide is provided with an extraction aperture for each of the pixels within the corresponding column. The electron beam may be accelerated through said extraction apertures so as to impinge on the corresponding pixel. The pixel then lights up, the brightness of the pixel being dependent on the beam current of the electron beam. The image information can be displayed consecutive addressing of each of the pixels.

For supplying electrons to the column beam guides, the known display device is provided with a gun section. The gun section is provided with a number of horizontal beam guides, each having a separate electron gun. The electron beams slalom in a direction parallel to the display screen in the horizontal beam guide and in the gun section part of the vertical beam guides.

The horizontal beam guides are arranged so that an electron beam originating from an electron gun can be deflected into any one of the vertical beam guides.

The known display device has six horizontal beam guides and consequently six electron guns.

It is a problem of the known display device that its construction is comparatively complicated and expensive. In particular a comparatively complicated gun section is required for injecting an electron beam into one of the vertical beam guides.

It is therefore an object of the invention to provide a display device as described in the opening paragraph which has a simplified construction.

For this purpose, the display device according to the invention is characterized in that the beam guide comprises a two-dimensional slalom guide, from which said electron beam can be extracted from said two-dimensional slalom guide.

In a two-dimensional slalom guide, the electron beam can be guided in two mutually perpendicular directions by means of slalom focusing. Thus, the two-dimensional slalom guide defines a guidance plane in which the electron beam can be guided. The electron beam can be guided to follow any desired beam path within said guidance plane.

Such a two-dimensional slalom guide is known per se from the patent U.S. Pat. No. 2,899,597. In this patent, the two-dimensional slalom guide is used in a storage tube or in a switching tube, whereas according to the invention the two-dimensional slalom guide is used in a display device.

Instead of a vertical beam guide for each column of pixels, the display device according to the invention has a two-dimensional slalom guide. In operation, the electron beam is extracted from the two-dimensional slalom guide so as to impinge on any predetermined picture element. This enables the electron beam to address the entire display screen.

A single electron gun can suffice for supplying the electron beam to the beam guide, whereas a comparatively complicated gun section is required in the known display device. In particular, this gun section comprises six electron guns and six horizontal beam guides.

According to the invention, the number of electron guns may be reduced and the horizontal beam guides may be omitted, thereby replacing the vertical beam guides for each of the columns of pixels with a single two-dimensional beam guide. The construction of the display device according to the invention is simplified thereby.

Although a single electron gun may be sufficient for addressing the entire screen, alternatively the display device may be provided with a small number of electron guns, such as two or four.

A further aspect of the invention is that the beam path of the electron beam can be fully customized within the guidance plane. This is advantageous because it provides undisturbed device operation if a local breakdown occurs in the slalom guide. In this case, the beam path may be adapted such that the electron beam avoids the location at which the breakdown occurs. In the known display device, if one of the vertical beam guides breaks down, effectively an entire column of pixels is affected or even disabled.

In a specific embodiment, the guidance plane is substantially parallel to the display screen. Generally, the two-dimensional slalom guide now has dimensions similar to those of the display screen and overlaps said display screen. This allows for a particularly simple construction of the display device. The guidance plane of the two-dimensional slalom guide may be enclosed between a front plate facing the display screen and a back plate.

In a particularly advantageous embodiment, the electron beam guide is provided with a number of slalom electrodes extending between the front plate and the back plate, in a direction substantially perpendicular to the display screen. The slalom electrodes render possible the slalom focusing of the electron beam in the beam guide, and may be provided as wires, pillars, or pins.

If the display device operates under vacuum conditions, the substantially perpendicular slalom electrodes provide the electron beam guide with an integrated vacuum support having a comparatively limited influence on the electron beam. A vacuum display device is thus obtained having a comparatively high image quality, in which additional vacuum support elements for the electron beam guide are not required.

Whenever the "beam path" of the electron beam is refered to hereinafter, this should be construed as being a virtual line connecting the slalom electrodes around which the slaloming electron beam travels. The actual slaloming path of the electron beam itself is referred to as "slalom path".

Preferably, the back plate, the front plate and the display screen are substantially flat. Within this application, an element being "flat" should be understood to indicate that the outer surfaces of said element extend in a flat plane.

It is desired to have a display device with a flat display screen. Also, the back plate, front plate, and display screen may now be positioned at comparatively small mutual distances. This allows for the construction of a comparatively thin display device. In a preferred embodiment, a slalom electrode can be switched between an electron beam repelling state and an electron beam attracting state. This allows the beam path of the electron beam to be suitably chosen in that the slalom electrodes along the desired beam path are switched to the attracting state and the other slalom electrodes are switched to the repelling state.

Generally, a slalom electrode in the attracting state receives a more positive, "high" voltage, whereas a slalom electrode in the repelling state receives a more negative, "low" voltage.

In a preferred embodiment, the slalom electrodes are arranged in rows and columns defining an array of cells, each picture element of the display screen corresponding to a cell. The slalom electrodes are provided at corner points of the cells, said cells thus having, for example, a square or rectangular shape. This is a particularly simple configuration of the slalom electrodes that enables the electron beam to scan all pixels.

Generally, the pixels are then also arranged in rows and columns. The electron beam may first be guided, as seen from the beam entrance, in the direction of the rows to the desired column, and then be deflected through a substantially right angle so as to be guided in the direction of the columns towards the cell corresponding to the predetermined picture element. In this way, the display screen is scanned in rows and columns.

In a further preferred embodiment, the front plate is provided with a beam extraction aperture for a cell, and the extraction means comprise an extraction electrode for extracting the electron beam through said beam extraction aperture.

A voltage applied to an extraction electrode on the front plate is increased and/or a voltage applied to an extraction electrode on the back plate is decreased for extracting the electron beam. The electron beam is pulled/pushed through the aperture in the front plate thereby and accelerated so as to impinge on the display screen.

In a particularly advantageous embodiment, the slalom electrodes are arranged in a delta-nabla configuration. The cells being defined by the slalom electrodes are then for example diamond-shaped.

This electron beam guide has a particularly high stability. The number of electrons that are lost from the electron beam by collision with the slalom wires or pillars is reduced in this beam guide, so that a comparatively large number of electrons is transmitted through the beam guide. The electron transmission coefficient of this beam guide is comparatively large.

A low electron loss allows the switching voltage to be reduced, the switching voltage being the voltage difference between the high voltage and low voltage that are applied to slalom electrodes in the attracting and in the repelling state, respectively. The reduced switching voltage allows for the use of comparatively inexpensive and power-efficient electronic circuitry for switching the slalom electrodes from the attracting to the repelling state and vice versa.

Moreover, this embodiment allows the pixels of the display screen and the beam extraction apertures in the front plate to be arranged in a delta-nabla configuration. This is particularly advantageous in the case of the beam extraction apertures, because a front plate with apertures in a delta-nabla configuration has an increased mechanical strength as compared with a front plate with apertures in a square configuration.

In a further embodiment, the electron gun is arranged to generate two separate electron beams having a mutual distance smaller than a slalom pitch, each of said two electron beams being guided in a different slalom path associated with the beam path.

The slalom pitch is defined as the distance between neighboring slalom electrodes.

An electron beam can travel around the slalom electrodes in two different slalom paths associated with a beam path, such that the first slalom path passes each slalom electrode along the beam path on the opposite side to that of the second slalom path.

As the beam current of an electron beam increases, space-charge repulsion of electrons in the beam gets stronger, which decreases the stability and transmission coefficient of the electron beam guide. This may be compensated for by increasing the switching voltage; however, this is undesired because more expensive switching circuitry is required and power usage is increased.

In this further embodiment, the two electron beams travel along the same beam path but follow different slalom paths. This distributes a comparatively high beam current over the two slalom paths. The electron beam guide has an increased stability and transmission at said comparatively high beam current, without increasing the required switching voltage. An electron beam with a comparatively high beam current is thus guided in a particularly efficient way.

In a further preferred embodiment, a plurality of electron guns are provided for generating a plurality of electron beams, each of said plurality of electron beams being receivable by the electron beam guide at a corresponding beam entrance, so as to guide said plurality of electron beams to the extraction means via substantially different beam paths.

Since the display device uses a two-dimensional slalom guide, an electron beam may be guided to each of the cells of the beam guide along a large number of different beam paths. In this embodiment, the electron beams from the different electron guns enter the beam guide at different beam entrances and are guided along different beam paths to the cell of the beam guide corresponding to the predetermined picture element.

All electron beams are extracted from said cell so as to impinge on the predetermined picture element of the display screen simultaneously. The display screen receives a single electron beam with a desired beam current, while in the electron beam guide each one of the plurality of electron beams has a comparatively low beam current. The stability of the electron beam guide is increased thereby, or alternatively a lower switching voltage may be used.

Since the transmission coefficient of the beam guide is generally smaller than 1, pixels for which the path length is comparatively large appear less bright than pixels for which the path length is comparatively small, because of the increased number of electrons being lost along the comparatively long beam path. This would give rise to variations in brightness within the displayed image.

Preferably, therefore, a beam path length is substantially equal for every picture element of the display screen. If a plurality of electron beams is used, this should be understood to mean that the average beam path length for all electron beams should be substantially equal for every pixel.

This can be realized by suitably choosing the beam paths. For example, if two electron guns are provided, both electron guns may be placed at opposite sides of a row of cells of the electron beam guide, so that the electron beams are guided through the row and enter the same column of cells.

The average distance between each of the two electron guns and said column is the same for all columns. This causes, the average beam path lengths of all electron beams to be substantially equal, and non-uniformity of the brightness of the image is substantially prevented.

If a single electron gun is used, the electron beam may be guided to the predetermined picture element along one beam path of a branched network of beam paths.

In a further preferred embodiment, each of the picture elements comprises a plurality of sub-pixels, and the display device is provided with post-selection means for passing the electron beam extracted from the electron beam guide to any one of the plurality of sub-pixels within the predetermined picture element. Said post-selection means may comprise an electrostatic deflector for each cell, the electrostatic deflector being positioned between the front plate and the display screen. Alternatively, magnetic deflection means may be provided as post-selection means.

In this embodiment, the slalom pitch may be greater than the mutual distance between the sub-pixels. This facilitates the construction of the beam guide and increases its stability, so that the image resolution of the display device remains comparatively high.

For example, each picture element may comprise three sub-pixels, the sub-pixels corresponding to the colors red, green, and blue, respectively. This is a particularly simple embodiment of a color display device.

These and other aspects of the display device according to the invention will now be elucidated with reference to the accompanying drawings, in which.

Figure 1:
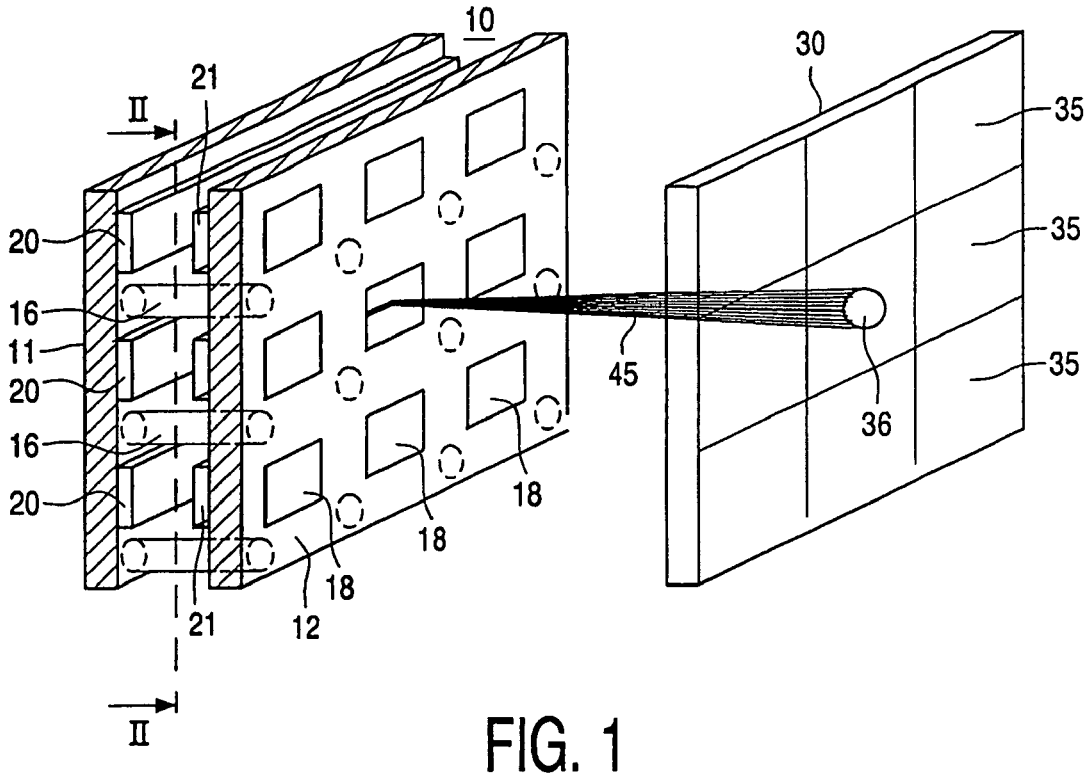
FIG. 1 is an isometric view of an embodiment of the display device according to the invention.

In a first embodiment of the display device according to the invention, as shown in FIG. 1, an electron beam 45 is generated by an electron gun 40 and injected at a side of the electron beam guide 10. Within the beam guide 10, the electron beam 45 slaloms around slalom electrodes 16 along the beam path, until the beam is extracted from the beam guide 10 and accelerated towards the display screen 30.

For extracting the electron beam 45, the beam guide 10 is provided with a separate beam extraction aperture 18 for each pixel 35 of the display screen 30.

If the electron beam 45 is to impinge on a predetermined pixel 35, the beam path of the electron beam 45 should be selected such that the electron beam 45 is guided to the beam extraction aperture 18 corresponding to said predetermined pixel 35. Here, the electron beam 45 is deflected through a substantially right angle, so that it passes through the beam extraction aperture 18 and impinges on the predetermined pixel 35.

The entire display screen 30 can be scanned by consecutive selection of each one of the picture elements 35. Each pixel 35 is provided with luminescent material, for example phosphors, which lights up when the electron beam 45 impinges on the pixel 35, the brightness being dependent on the beam current of the electron beam 45.

During the scanning of the display screen 30, the beam current of the electron beam 45 is modulated in accordance with image information that the display device receives. Image information can thus be displayed on the display screen 30.

The beam guide 10 consists of a back plate 11 and a front plate 12 provided with the beam extraction apertures 18. The slalom electrodes 16 extend between the back plate 11 and the front plate 12 and act as an integrated vacuum support for the electron beam guide 10.

The back plate 11, the front plate 12, and the display screen 30 consist of flat plates. The thickness of the back plate 11 and the front plate 12 is, for example, 0.3 mm, and their mutual distance is, for example, 1.2 mm. The distance between the front plate 12 and the display screen 30 is, for example, 4 mm. Generally, a spacer (not shown) is provided between the front plate 12 and the display screen 30 to provide vacuum support.

Figure 2:
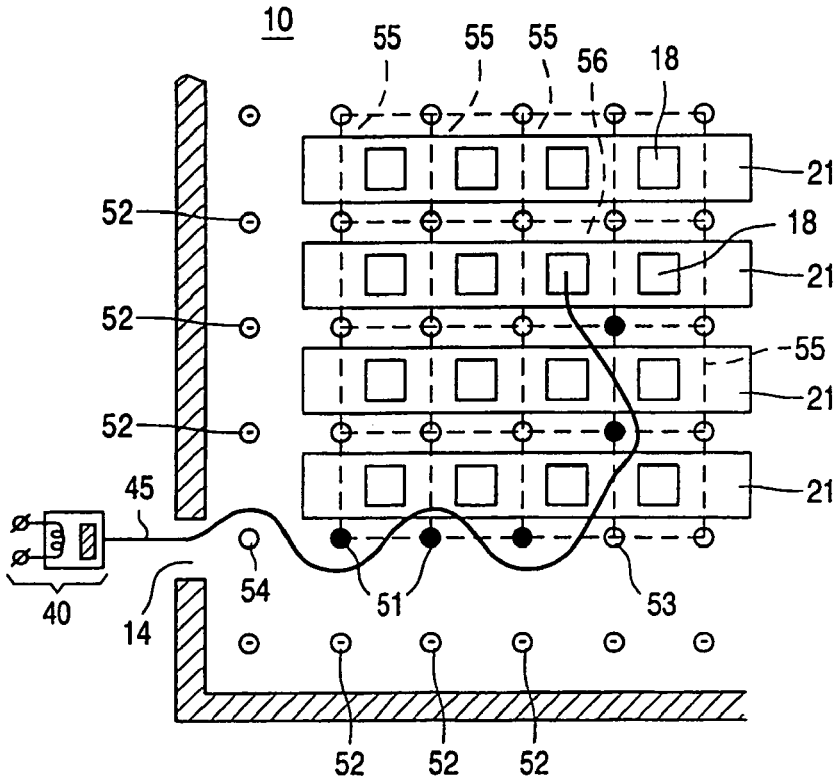
FIG. 2 shows the electron gun and the electron beam guide of the display device in operation in a cross-section taken on the guidance plane.

As can be seen in FIG. 2, the electron beam 45 is generated by the electron gun 40 and enters the electron beam guide 10 through a beam entrance 14 in the side. The electron gun 40 has, for example, a diode or a triode configuration.

In this embodiment of the beam guide 10, the slalom electrodes 16 are arranged in rows and columns defining an array of square cells 55. The slalom electrodes 16 are positioned at regular intervals, the slalom pitch being 1.5 mm. The slalom electrodes 16 comprise cylindrical wires having a diameter of 0.15 mm.

A picture element 36, to which the electron beam 45 is to be guided, can be selected in that a beam path is defined from the beam entrance 14 to a cell 56 corresponding to said picture element 36. This cell is referred to as "selected cell" hereinafter.

A beam path can be defined by means of attracting electrodes 51 and repelling electrodes 52, more particularly by switching the slalom electrodes 16 along the beam path to the electron attracting state 51, i.e. supplying them with a "high" voltage, and by switching the other slalom electrodes 16 to the electron repelling state 52, i.e. supplying them with a "low" voltage.

At each cell 55, the front plate 12 is provided with a beam extraction aperture 18, so that each cell 55 corresponds to a pixel 35 of the display screen 30.

The high voltage is, for example, 350 V, and the low voltage is, for example, −100 V. Thus, the switching voltage equals 450 V in this embodiment.

The electron beam 45 is extracted from the selected cell 56 through the beam extraction aperture 18 in said selected cell, in cooperation with extraction electrodes 20 and 21 provided on the front plate 11 and the back plate 12, respectively. For each row of pixels, there is a corresponding pair of extraction electrodes 20, 21. The extraction electrodes are also referred to as "row electrodes" hereinafter.

A slalom electrode 16 closest to the beam entrance 14 acts as a first electrode 54 which is supplied with a separate voltage. Its purpose is to start the slaloming movement of the electron beam 45 and to set the slalom angle to a value that enables the electron beam to be guided as efficiently as possible.

The slalom angle is defined as the angle that the slalom path encloses with the beam path at an intersection point of the paths.

An efficient value of the slalom angle is, for example, 35 or 45 degrees. For setting this slalom angle, a voltage of, for example, +100 V is applied to the first electrode 54.

At this slalom angle, the electrons are well confined within the electron beam 45. The distance of the electron beam 45 to each attracting electrode 51 is such that the number of electrons colliding with the attracting electrode is comparatively low. At the same time, the influence of the repelling electrodes 52 is not large enough to knock a substantial number of electrons out of the electron beam 45, as would happen at larger values of the slalom angle. Thus, the electron transmission coefficient of the electron beam guide 10 is as high as possible.

After the first electrode 54, the electron beam 45 is first guided along the bottom row of slalom electrodes 16, to the column of slalom electrodes 16 corresponding to the selected cell 56. Here the electron beam 45 is deflected by a deflection electrode 53, so that the electron beam 45 is now guided along the column. The electron beam 45 enters the selected cell 56, from which it is extracted through the beam extraction aperture 18. For this purpose, the row electrodes 20, 21 corresponding to the selected cell 56 are supplied with a voltage of, for example, 250 V or 500 V.

The deflection electrode 53 is the slalom electrode 16 at the intersection of the bottom row and the column corresponding to the selected cell 56. It may be supplied with the low voltage or alternatively with a separate "intermediate" voltage for deflecting the electron beam 45 into the column such that the slalom angle is set to the desired value in said column. In this embodiment, the deflection electrode 53 is provided with an intermediate voltage of, for example, +50 V.

Figure 3:
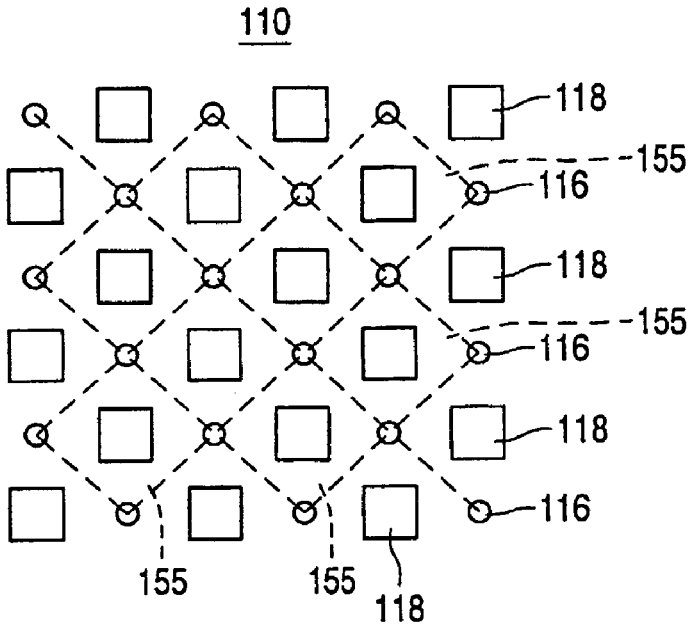
FIG. 3 is an alternative configuration of the slalom electrodes and the beam extracting apertures.

In alternative configurations, it is possible to arrange the slalom electrodes 16 and the beam extraction apertures 18 differently. An example of an alternative configuration is shown in FIG. 3.

The slalom electrodes 116 are arranged in a delta-nabla configuration, defining cells 155 having a diamond shape. Neighboring slalom electrodes 116 within a row or within a column are located at a mutual distance of 1.5 mm. The slalom pitch equals this distance in this embodiment.

The beam extraction apertures 118 are also arranged in a delta-nabla configuration, with each beam extraction aperture 118 located at the center of a diamond-shaped cell 155.

The electron beam guide 110, provided with this alternative configuration of the slalom electrodes 116 and beam extraction apertures 118 has an increased stability and a comparatively high electron transmission coefficient.

The switching voltage is reduced in this configuration. The low voltage applied to repelling slalom electrodes is now, for example, 0 V, and the high voltage applied to attracting slalom electrodes is now, for example, +200 V. The switching voltage is 200 V in this example, as against 450 V in the configuration having square-shaped cells.

Furthermore, a separate intermediate voltage for setting the correct slalom angle after a deflection of the electron beam is not required in the electron beam guide 110. If an electron beam is deflected from a row into a column, or vice versa, the slalom angle is automatically set to the desired value because of the configuration of the slalom electrodes 116.

Figure 4:
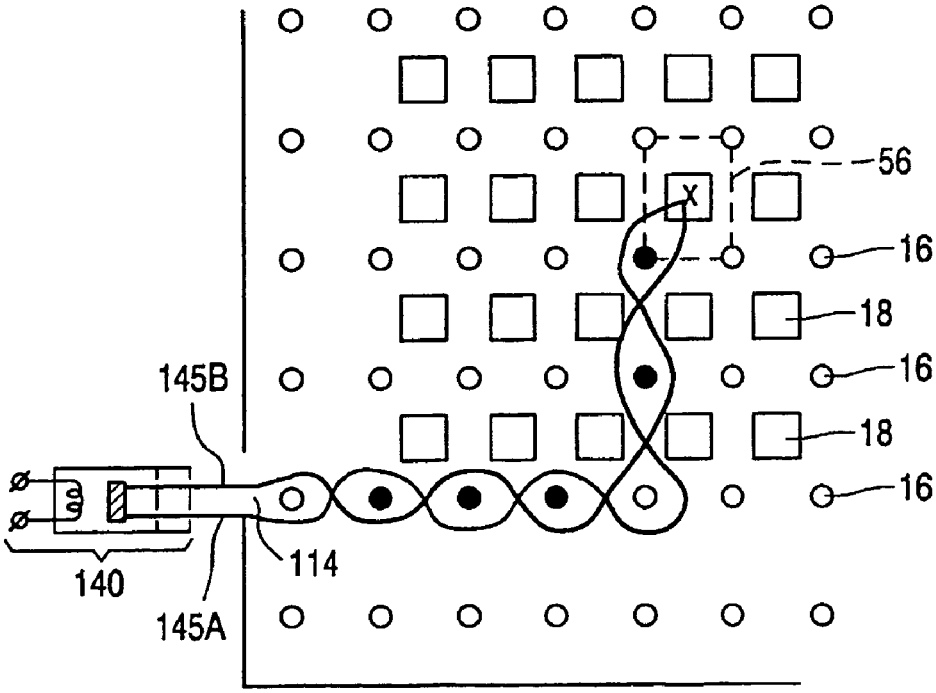
FIG. 4 shows the electron beam guide with two electron beams in different guiding modes.

In the embodiment as shown in FIG. 4, the electron gun 140 generates a pair of electron beams 145A, 145B. The electron beams 145A, 145B are both injected into the first embodiment of the electron beam guide 10 through the beam entrance 14.

Between the electron gun 140 and the beam entrance 14, the electron beams 145A, 145B run substantially parallel. The mutual distance of the electron beams 145A, 145B is such that the electron beams 145A, 145B are injected into different slalom paths of the same beam path, both at a desired slalom angle.

The two electron beams 145A, 145B are guided along the same beam path, passing on opposite sides of each attracting electrode 51 of the beam path and crossing each other in between neighboring attracting electrodes. Both electron beams 145A, 145B are extracted through the same beam extraction aperture 18 towards the predetermined pixel 36 of the display screen 30, thereby merging into a single electron beam having a comparatively high beam current.

This comparatively high beam current is the sum of the beam currents of the electron beams 145A, 145B. If a single electron beam having a similar comparatively high beam current were guided through the electron beam guide 10, a significant number of electrons would be lost therefrom owing to space-charge repulsion in the beam. In this embodiment, the comparatively high beam current is distributed over the two electron beams 145A, 145B within the electron beam guide 10, the stability of the electron beam guide 10 is increased, and/or the switching voltage is reduced.

The display device may alternatively be provided with multiple electron guns, each generating one or two electron beams. A comparatively high beam current may then be distributed over a number of electron beams greater than two. For example, four or eight electron beams are guided to the cell corresponding to the predetermined picture element.

Figure 5:
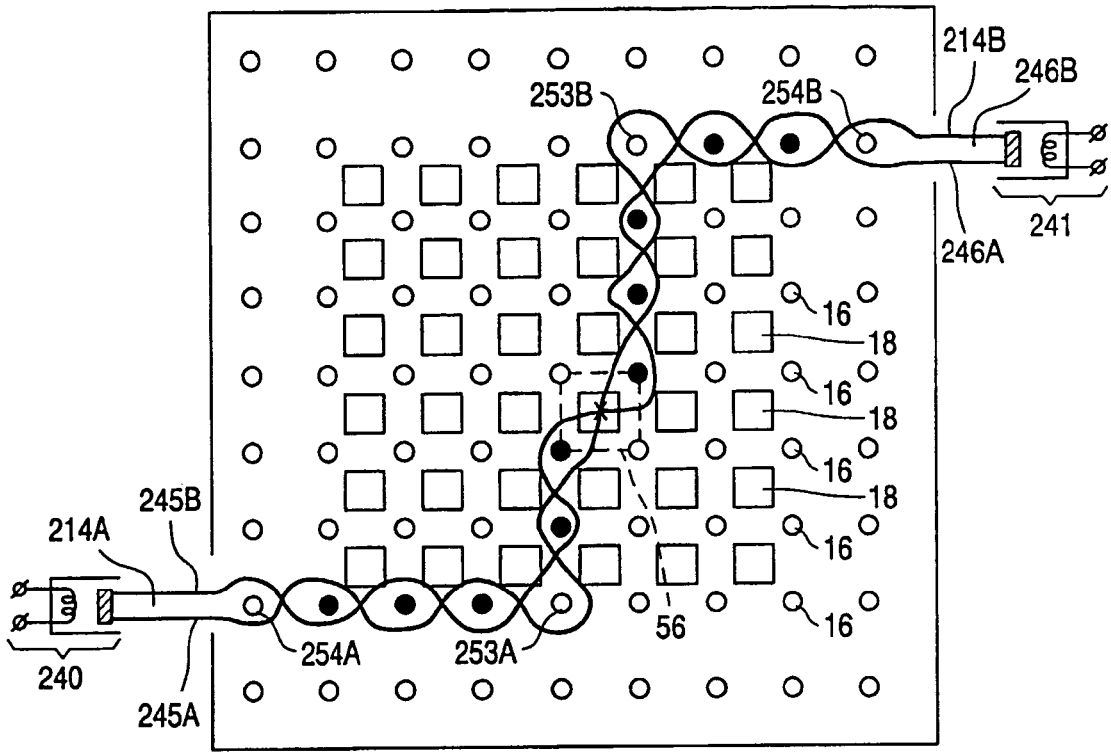
FIG. 5 shows the electron beam guide receiving electron beams from two electron guns.

In FIG. 5, two electron guns 240, 241 are positioned on diagonally opposed sides of the electron beam guide 10. Each electron gun 240, 241 generates a pair of electron beams 245A, 245B; 246A, 246B, which are injected into the electron beam guide 10 such that each pair of electron beams enters the electron beam guide 10 through a corresponding beam entrance 214A, 214B.

A first electrode 254A, 254B is provided near each beam entrance 214A, 214B, so that each pair of electron beams 245A, 246A; 245BA, 246B travels along its corresponding slalom path at an efficient slalom angle.

As seen from the display screen 30, the electron beams 245A, 246A of the first pair are guided towards the right side of the electron beam guide 10 along a beam path that extends along the bottom row of slalom electrodes 16 to a slalom electrode acting as a deflection electrode 253A. This deflection electrode 253A deflects the first pair of electron beams 245A, 246A into a first column of slalom electrodes 16, so as to enter the selected cell 56 from the bottom.

The electron beams 245B, 246B of the second pair are guided towards the left side of the electron beam guide 10 along a beam path that extends along the top row of slalom electrodes 16 to a slalom electrode acting as a deflection electrode 253B. This deflection electrode 253B deflects the second pair of electron beams 245B, 246B into a second column of slalom electrodes 16, adjoining said first column, so as to enter the selected cell 56 from the top.

All four electron beams 245A, 245B, 246A, 246B are extracted through the beam extraction aperture 18 towards the selected pixel 36 of the display screen 30, thereby merging in a single electron beam. Since a comparatively high beam current of the single electron beam near the display screen 30 is now distributed over four electron beams within the electron beam guide 10, the stability of the electron beam guide is further increased and/or the switching voltage is further reduced.

This embodiment has the further advantage that the average of the beam path lengths of the first pair of electron beams 245A, 246A and the second pair of electron beams 245B, 246B is substantially the same for all picture elements 35 of the display screen 30. This prevents variations in image brightness between pixels, caused by a length of the beam path varying with the position of the pixel 35 on the display screen 30.

Figure 6:
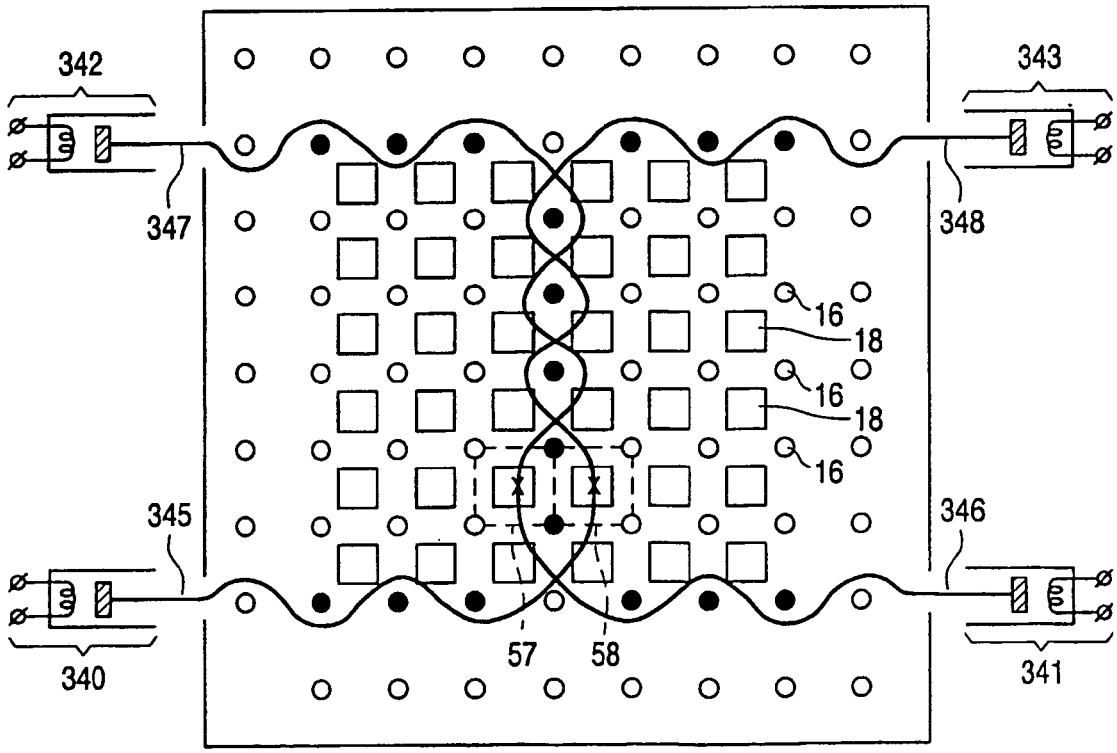
FIG. 6 shows the electron beam guide receiving electron beams from four electron guns.

A configuration of the electron beam guide 10 with four electron guns 340, 341, 342, 343 is shown in FIG. 6. Each gun is positioned at a separate corner of the electron beam guide 10 and generates a single electron beam 345, 346, 347, 348.

In this configuration, two neighboring pixels can be addressed at the same time in that the electron beams 345, 346, 347, 348 are guided to neighboring selected cells 57, 58. The first pixel corresponding to the first selected cell 57 receives the electron beams 346, 347 from electron guns 341, 342, and the second pixel corresponding to the second selected cell 58 receives the electron beams 345, 348 from electron guns 340,343.

This configuration enables the use of an interlacing addressing scheme of the pixels of the display device. For example, the pixels in an odd column are addressed by means of electron beams 346, 347, and the pixels in an even column are simultaneously addressed by means of electron beams 345, 348. Thus, the line frequency may be halved.

Figure 7:
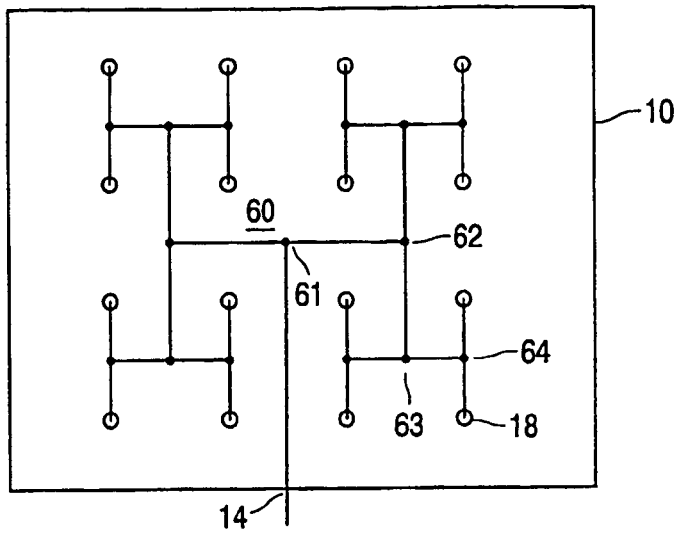
FIG. 7 shows a branched network of electron beam paths.

An embodiment having a comparatively good image brightness uniformity between pixels, in which only a single electron gun 440 is required, selects the beam path towards the selected cell 56 from a branched network 60 of beam paths. Such a branched network 60 is shown in FIG. 7.

The electron gun 440 generates an electron beam 445 which enters a two-dimensional slalom guide, in this case the first embodiment of the electron beam guide 10, at the bottom side. The branched network 60 comprises a node 61, 62, 63, 64 at each junction of two branches.

The slalom electrode near or at each of the nodes 61, 62, 63, 64 along the beam path operates as a deflection electrode. The slalom electrodes 16 forming the beam guide 10 can be addressed such that, at any node, the electron beam may follow either branch of the network 60 leading from said node.

The electron beam path extends from the beam entrance 14 via the nodes 61, 62, 63, 64 to the beam extraction aperture 18 corresponding to the selected pixel 36 of the display screen 30. The branched network 60 is a so called H-fractal network as known per se from patent U.S. Pat. No. 5,781,166. The beam path has the same length for all pixels 35 of the display screen 30.

If such a branched network of beam paths is used, the extraction means cannot be supplied with row electrodes, but must instead, comprise, for example, a separate extraction electrode for each cell.

It is advantageous if the slalom pitch is greater than the distance between pixels on the display screen. This makes for a more stable operation of the slalom guide and a comparatively inexpensive manufacture thereof.

For this purpose, each picture element may comprise a plurality of sub-pixels. Each cell of the electron beam guide, and each beam extraction aperture, now corresponds to a plurality of sub-pixels. Therefore, the number of cells no longer has a 1:1 relation to the number of pixels on the display screen, and thus to the image resolution of the display device. Because of this, the slalom pitch of the electron beam guide may be increased without compromising the image resolution.

Figure 8:
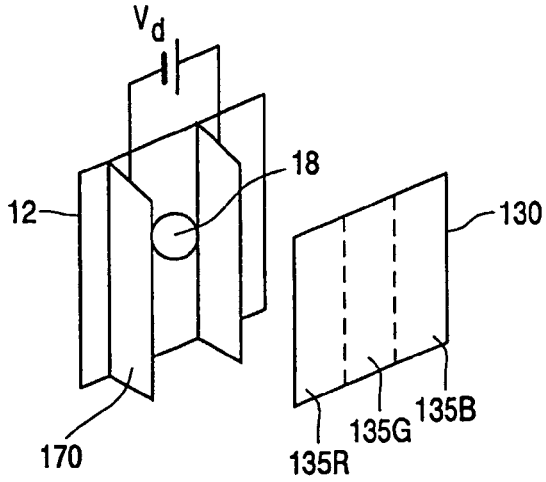
FIG. 8 shows part of the electron beam guide with a single beam extraction aperture, corresponding to a color picture element comprising three sub-pixels.

An embodiment of this, wherein each pixel comprises three subpixels 135R, 135G, 135B arranged in-line in the horizontal direction, is shown in FIG. 8 for a single beam extraction aperture and pixel.

This embodiment is particularly advantageous for use in a color display device, in which each of the subpixels 135R, 135G, 135B corresponds to one of the phosphor colors red, green, and blue. The sub-pixels 135R, 135G, 135B are comparatively close to each other, so that a viewer observes the three sub-pixels as one color pixel, while at the same time the slalom pitch of the basic electron beam guide 10 can remain unchanged in this embodiment.

Between the beam extraction aperture 18 and the display screen 130, conventional electrostatic deflection plates 170 are provided as post-selection means for deflecting the electron beam exiting from the beam extraction aperture 18 to one of the sub-pixels 135R, 135G, 135B. Each of the sub-pixels 135R, 135G, 135B can be selected by switching of a deflection voltage Vd applied across the electrostatic deflection plates 170.

In this embodiment, if the deflection voltage Vd is 0 Volt, the electron beam is not deflected and impinges on the green sub-pixel 135G. If the deflection voltage is, for example, −200 V, the electron beam is deflected to the left, as seen from the display screen 130, and impinges on the red sub-pixel 135R. If the deflection voltage is, for example, +200 V, the electron beam is deflected to the right, as seen from the display screen 130, and impinges on the blue sub-pixel 135B.

Figure 9:
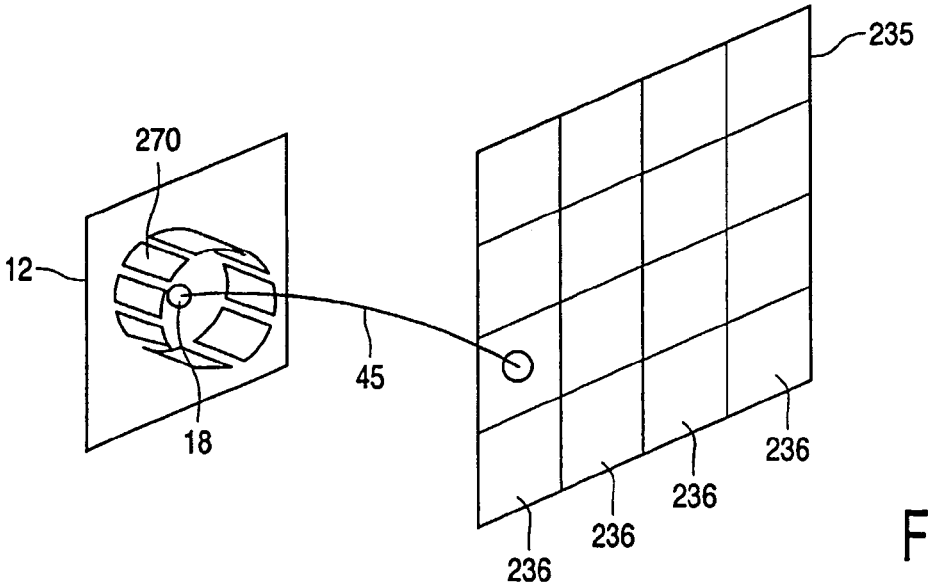
FIG. 9 shows part of the electron beam guide with a single beam extraction aperture, corresponding to a picture element comprising a 4×4 block of sub-pixels.

It is alternatively possible that each picture element comprises a block of sub-pixels, for example, an 8×8 or a 16×16 block of sub-pixels, or a 24×8 or a 48×16 block of sub-pixels for use in a color display device. The pixels 235 of the display screen now define "tiles" of sub-pixels, each tile corresponding to one beam extraction aperture 218. This is shown in FIG. 9 for a tile comprising 4×4 sub-pixels 236.

Post-selection means are provided between the beam extraction aperture 18 and the display screen 230 to deflect the electron beam 45 that exited from the beam extraction aperture 18 to any sub-pixel within the corresponding tile 235. In this embodiment, the post-selection means comprise an electrostatic multipole deflector 270 as commonly known in the state of the art. The electrostatic multipole deflector 270 is capable of deflecting the electron beam 45 in the horizontal and the vertical directions.

This embodiment has the advantage that the slalom pitch is greater compared with the distance between neighboring sub-pixels. This facilitates the slalom pitch design and allows for easy construction thereof. At the same time, the display device has a desired, high image resolution.

The drawings are schematic and not true to scale. In the drawings, embodiments of the display device are shown with only a few pixels for simplicity's sake, whereas an actual display device would have, for example, 800×600 (color) pixels. Although the invention has been described in connection with preferred embodiments, it should be understood that the invention is not to be construed as being limited to the preferred embodiments. It includes all combinations of elements described therein, and variations which could be made thereon by a skilled person, within the scope of the appended claims.

The invention claimed is:

1. A display device, comprising:

a display screen for displaying image information, having a predetermined number of luminescent picture elements;

an electron gun for generating an electron beam and an electron beam guide for receiving the electron beam at a beam entrance and guiding the electron beam along a beam path to extraction means for extracting the electron beam from the beam guide towards a predetermined picture element of the display screen, wherein the electron beam guide comprises a two-dimensional slalom guide arranged in rows and columns that define an array of cells opposite the picture elements, and the extraction means are arranged to extract the electron beam from the two-dimensional slalom guide.

2. The display device of claim 1, wherein the two-dimensional slalom guide defines a guidance plane in which the electron beam can be guided, the guidance plane being substantially parallel to the display screen.

3. The display device of claim 2, wherein the electron beam guide is provided with a number of slalom electrodes extending in a direction substantially perpendicular to the display screen, between a back plate and a front plate facing the display screen.

4. The display device of claim 3, wherein the back plate, the front plate, and the display screen are substantially flat.

5. The display device of claim 3, wherein a slalom electrode can be switched between an electron beam repelling state and an electron beam attracting state.

6. The display device of claim 5, wherein the slalom electrodes are arranged in rows and columns defining an array of cells, each picture element of the display screen corresponding to a cell.

7. The display device of claim 6, wherein the front plate is provided with a beam extraction aperture for a cell, and the extraction means comprise an extraction electrode (20, 21) for extracting the electron beam through the beam extraction aperture.

8. The display device of claim 6, wherein the slalom electrodes are arranged in a delta-nabla configuration.

9. The display device of claim 1, wherein the electron gun is arranged to generate two separate electron beams having a mutual distance smaller than a slalom pitch, each of the two electron beams being guided in a different guiding mode associated with the beam path.

10. The display device of claim 1, wherein a plurality of electron guns are provided for generating a plurality of electron beams such that each of the plurality of electron beams can be received by the electron beam guide at a corresponding beam entrance so as to guide the plurality of electron beams to the extraction means via substantially different individual beam paths.

11. The display device of claim 10, wherein an average beam path length is substantially the same for all picture elements of the display screen.

12. The display device of claim 1, wherein an average beam path length is substantially the same for all picture elements of the display screen.

13. The display device of claim 1, wherein a picture element comprises a plurality of sub-pixels, and the display device is provided with post-selection means for passing the electron beam extracted from the electron beam guide to any one of the plurality of sub-pixels within the predetermined picture element.

14. The display device of claim 13, wherein each of the picture elements comprises three sub-pixels, the three sub-pixels corresponding to the colors red, green, and blue, respectively.

15. A display device, comprising:

a display screen that includes a plurality of luminescent picture elements;

an electron emitter system that is configured to generate one or more electron beams, an electron beam guide that is configured to:

receive the one or more electron beams at one or more beam entrances, and guide the one or more electron beams along one or more beam paths towards a selected picture element of the display screen, and one or more extraction elements that are configured to extract the one or more electron beams from the beam guide in a direction toward the predetermined picture element, wherein the electron beam guide comprises a two-dimensional slalom guide arranged in rows and columns defining an array of cells opposite the picture elements.

16. The display device of claim 15, wherein the one or more beam paths provide an average beam path length that is substantially the same for each of the picture elements of the display screen.

17. The display device of claim 15, including post-selection elements that are configured to further guide the one or more electron beams from the one or more extraction elements toward the selected picture element.

18. The display device of claim 17, wherein each picture element includes a plurality of sub-pixels, and one or more of the post-selection elements are configured to guide the one or more electron beams to a select sub-pixel of the plurality of sub-pixels of the selected picture element.

19. The display device of claim 15, wherein the slalom guide includes a plurality of slalom electrodes that extend in a direction substantially perpendicular to the display screen.

20. The display device of claim 19, wherein the one or more extraction elements extend in a direction substantially parallel to the display screen.

* * * * *